United States Patent [19]

Aumann

[11] 3,955,623

[45] May 11, 1976

[54] SUBSEA CONTROL VALVE APPARATUS

[75] Inventor: James T. Aumann, Houston, Tex.

[73] Assignee: Schlumberger Technology Corporation, New York, N.Y.

[22] Filed: Apr. 22, 1974

[21] Appl. No.: 462,824

[52] U.S. Cl. ..... 166/.6; 166/224 A; 251/63.4

[51] Int. Cl.[2] ..... E21B 33/00

[58] Field of Search ..... 166/.6, 224, 224 A, 166/212; 251/63.4, 63.6

[56] References Cited

UNITED STATES PATENTS

| | | | |
|---|---|---|---|
| 3,411,576 | 11/1968 | Taylor | 166/224 A |
| 3,665,955 | 5/1972 | Conner | 166/224 X |
| 3,713,485 | 1/1973 | Holbert, Jr. | 166/224 A |
| 3,729,020 | 4/1973 | Koci | 251/63.6 |
| 3,786,865 | 1/1974 | Taush et al. | 166/224 A |
| 3,786,866 | 1/1974 | Tausch et al. | 166/224 A |
| 3,809,201 | 5/1974 | Miyanishi et al. | 251/63.4 |
| 3,844,346 | 10/1974 | Mott | 166/212 |
| 3,870,101 | 3/1975 | Helmus | 166/.5 |

*Primary Examiner*—Ernest R. Purser
*Assistant Examiner*—Richard E. Favreau
*Attorney, Agent, or Firm*—David L. Moseley; William R. Sherman; Stewart F. Moore

[57] ABSTRACT

A control valve apparatus adapted to be stationed in a subsea blowout preventer stack and used in connection with a production or drill stem test of an offshore well from a floating vessel, includes a valve section and a control section that are releasably connected together by a latch mechanism. The valve section has one or more fail-close valves for controlling the opening of the well, and the control section and latch mechanism are hydraulically operable for respectively actuating the valves and disconnecting the control section to enable its retrieval to the vessel leaving the valve section in place.

17 Claims, 3 Drawing Figures

SUBSEA CONTROL VALVE APPARATUS

Figure 1:
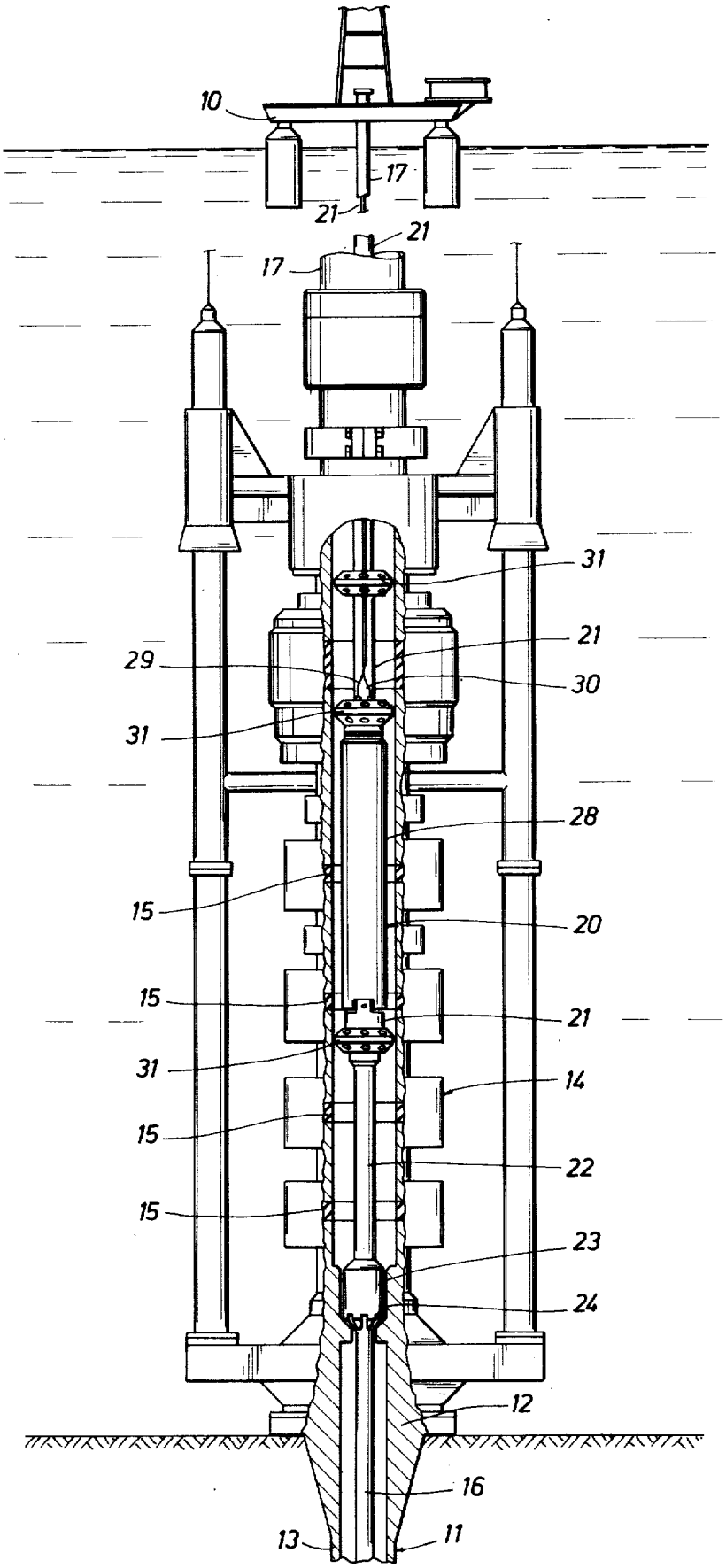

This invention relates generally to well tools used to control the flow of fluids from wells, and particularly to a new and improved valve apparatus adapted to be removably positioned within a subsea wellhead during production testing, or the like, of an offshore well from a floating vessel.

The data that can be obtained from a drill stem or a production testing of an oil or gas well is of great value in identifying commercial pay zones. The data is rather easily obtained where the wellhead and the production installation are in place, which is the case, for example, for land based wells. Unfortunately, however, in the case of offshore exploratory drilling, completion costs are so substantial that extensive tests are needed not only to identify commercial zones but also to provide a basis for a determination of the type of surface equipment that will be necessary to produce the well.

One method for conducting such tests is to equip the well with a subsea wellhead and allow the well to flow into mobile production testing units employed at the rig. Once the required information has been obtained, the well can be closed temporarily through use of a downhole plug in conjunction with a cap fitted on top of the casing string. The well can be left shut-in while decisions on completion are made, based upon the test results. To complete the well, a workover platform is placed on the well to allow reentry. The foregoing procedure is slow, however, and ill adapted in case the well has to be abandoned in case of emergency. Moreover, it is necessary to remove the subsea blowout preventer "stack" in order to install the wellhead, which reduces the control of the well in a highly undesirable manner.

Over the past few years, techniques and equipment have been developed for testing an offshore well without removing the blowout preventer stack, and which allow such testing to be conducted from floating or semi-submersible vessels and supports. For example, the apparatus shown in U.S. Pat. No. Re. 27,464, is suitable for this purpose, and in addition provides a subsea master valve which can be controlled from the surface during testing operations. The device is fail-safe, in the sense that it normally is closed in the absence of control pressure, and can be utilized to temporarily plug the well after production tests. The well can be reopened for further tests, and for completion operations such as perforating and cementing at the end of production or drill stem tests.

Although the aforementioned equipment has been widely used, it suffers from a number of significant shortcomings. The valve system employs tandem ball valve systems with hydraulic actuation via various flow passages in the tool body that is seated within the blowout preventer stack. The valve construction is inherently complex both from a mechanical and a hydraulic standpoint, and thus is subject to various malfunctions such as sticking and leakage of control fluid. In addition, the valve body has a lengthy construction due to the complex valve mechanisms housed therein, and to their method of actuation, to the extent that it is not possible for the uppermost blind rams of the typical blowout preventer stack to be closed thereabove in case of emergency disconnection of the control pod that leads from the top of the valve body up to the floor of the drilling vessel. Therefore complete control of the well is not possible, in case the ball valves for some reason fail to close and leave the pipe string leading to the formation open. Moreover, the method of disconnection used for this device leaves the fluid control line passages and other mechanisms exposed to contamination by sea water and/or drilling mud.

It is one object of the present invention to provide a new and improved subsea test valve apparatus that is more simple in construction and foolproof in operation.

Another object of the present invention is to provide a new and improved subsea test valve apparatus comprised of a valve body assembly and a releasably coupled valve control assembly constructed and arranged such that when the control assembly is released from the body, rams of the blowout preventer stack within which the body is situated can be closed thereabove for complete control of the well.

Yet another object of the present invention is to provide a new and improved subsea test valve apparatus wherein all of the hydraulically operable valve actuator means and the releasable connector mechanisms are situated within the portion of the apparatus which is released and withdrawn to the surface upon disconnection, thereby preventing contamination of these systems by sea water or drilling mud.

These and other objects are attained in accordance with the concepts of the present invention through the provision of a valve body having a flow passage and sized and arranged to be positioned and supported within the opening through a subsea blowout preventer stack. The valve body has valve means therein, preferably comprising at least one flapper valve element, arranged for pivotal rotation between an open position to the side of the flow passage and a closed position against a valve seat transverse to the flow passage, for controlling the flow of well fluids from conduit means extending downwardly into the well bore. A valve control assembly connected to the lower end of a flow conduit leading upwardly to the drilling vessel is arranged to be releasably connected to the valve body by a hydraulically operable latch mechanism carried by the control assembly. The control assembly further includes a hydraulically operable valve actuator system including a vertically movable actuator sleeve or "stringer" and a piston member coupled to the sleeve in such a manner that the pressure of a control fluid supplied via a supply line from the surface causes the piston member and the actuator sleeve to shift downwardly, forcing the lower end of the sleeve through the valve seat in the valve body and thus swinging the valve element to open position. In the absence of applied control pressure, a power spring in the control assembly functions to draw the lower end of the actuator sleeve upwardly through the valve seat, enabling the valve element to automatically close. Thus arranged the valve element is a "fail-close" mechanism to ensure control of the well.

The latch mechanism that releasably couples the control assembly to the valve body comprises a locking sleeve that is movable from an upper position where a series of latch dogs are released, to a lower position where the dogs are locked in coupled relation with the valve body, with the locking sleeve being biased toward the lower position by means such as a coil spring. A hydraulically operable piston means is responsive to control pressure in another line leading to the surface so that pressure can be applied to shift the locking sleeve upwardly to released position.

Thus in accordance with the principles of the present invention, all of the hydraulically operable mechanisms are incorporated into the valve control system which can be released from the valve body and retrieved to the drilling vessel or other support. This particular arrangement enables the valve body to be of relatively short length, making it possible to close the upper rams (normally blind rams) of the blowout preventer, upon disconnection, to ensure complete control of the well. Moreover, the various hydraulic control systems cannot become contaminated by sea water or drilling mud. The use of one or more flapper valve elements provides a much improved system in terms of simplicity and reliabilty in operation, together with reduced manufacturing costs.

Figure 2A:
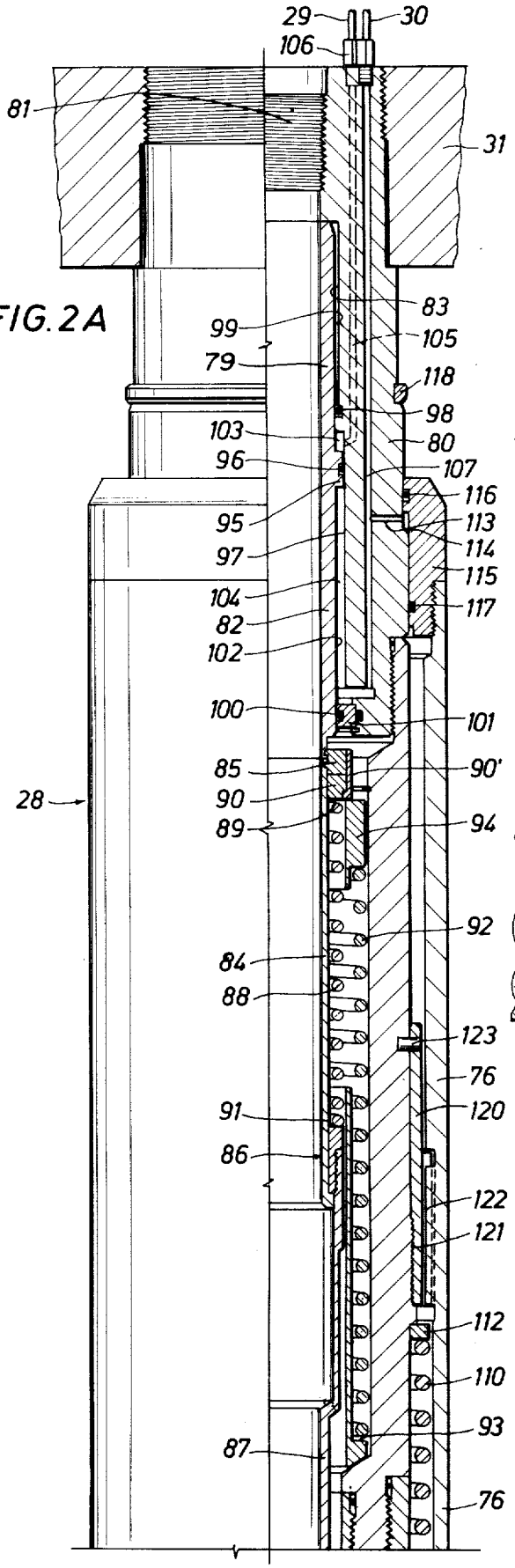
Figure 2B:
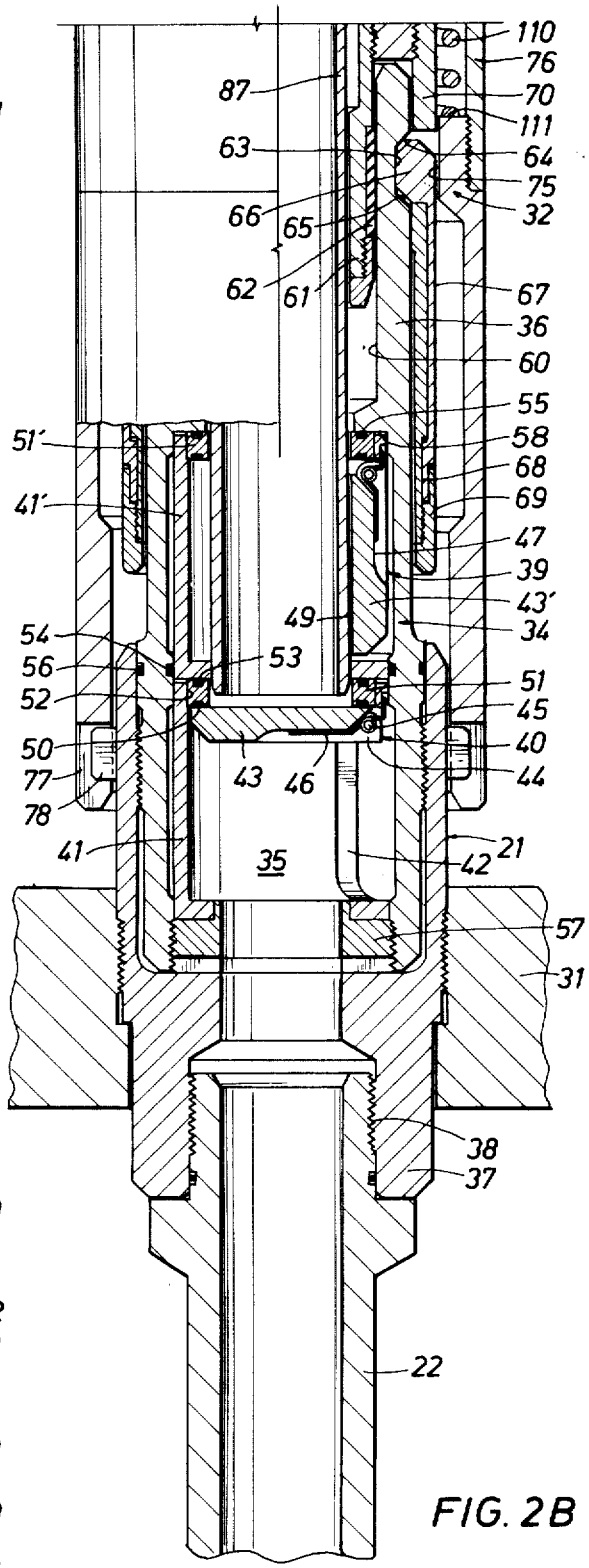

The present invention has other objects and advantages which will become more clearly apparent in connection with the following detailed description of a preferred embodiment, taken in conjunction with the appended drawings, in which:

FIG. 1 is a schematic view of an offshore well installation undergoing a drill stem or production test utilizing a subsea control valve apparatus constructed in accordance with the principles of the present invention; and FIGS. 2A and 2B are longitudinal sectional views of the control valve apparatus with the valve body assembly and the valve control assembly releasably connected together, FIG. 2B forming a lower continuation of FIG. 2A.

Referring initially to FIG. 1, there is shown somewhat schematically a floating or semi-submersible drilling vessel 10 stationed over an offshore well 11. A casing head 12 is fixed to the top of the well casing 13 and is connected to a blowout preventer stack 14 that has laterally movable rams 15 adapted when closed to shut-off the annulus between the casing 10 and a production tubing 16 or other conduit extending from the vessel 10 into the well. A marine riser 17 is connected in a conventional manner to the top of the blowout preventer stack and extends upwardly to a point above the water surface where it is coupled to the vessel by a typical riser tensioning system (not shown). Various hydraulic lines and the like extend from onboard control panels down to the blowout preventer stack in order to provide for hydraulic actuation of the various components thereof in a well known manner.

Inside the BOP stack 14 is positioned a control valve apparatus 20 constructed in accordance with the principles of the present invention and connected into the flow conduit 16 leading from the surface downward to the well formation undergoing test. The control valve apparatus 20 includes a valve section 21 connected by a slick joint 22 to a fluted hanger flange 23 which is sized and arranged to rest on shoulder surface 24 at the lower end of the stack 14. The lower rams of the BOP provide for closure around the slick joint 22, whereas the hanger flange 23 supports the pipe string 16 extending into the well. Releasably connected to the top of the valve section 21 is a hydraulically operated valve control section 28 that incorporates mechanisms which function to open one or more valves within the body 21 in response to the application of fluid pressure to a control line 29 extending upwardly alongside the pipe string 21 to the vessel 10, and a releasable connector that enables selective connection and disconnection of the section 28 to and from the valve section 21 in response to pressure of fluid in a second control line 30.

A plurality of guide flanges 31 serve to center the assembly 20 within the bore of the BOP stack 14 in a typical manner.

Turning now to a more detailed description of the control valve apparatus 14, as shown in FIGS. 2A and 2B the apparatus comprises the combination of the valve body section 21 and a control section 28 which are releasably connected together by a latch mechanism 32 as will be described in further detail below. The valve section 21 includes a tubular body member 34 (FIG. 2B) having an internal fluid flow passage 35 extending longitudinally therethrough, and is constituted by threadedly interconnected parts providing an upper latching sub 36 and a lower coupling sub 37. The coupling sub 37 is provided with internal threads 38 at its lower end adapted for connection to the slick joint 22 that is, in turn, connected to the fluted hanger flange 23 which is supported by the inwardly extending shoulder 24 near the lower end of the blowout preventer stack 14 as previously described with regard to FIG. 1. Upper and lower valve assemblies 39 and 40 are carried within the section 21. Each assembly is of an identical configuration, and includes a cage 41 having a window 42 cut in one side. A "flapper" valve element 43 in the form of a disc with an ear 44 is hinged to the cage 41 by a transverse pivot pin 45 in such a manner that the valve element is swingable from an open position disposed within the window 42 as shown for the upper assembly 39, and a closed position across the flow passage 35 as shown for the lower assembly 40. A coiled hinge spring 46 surrounds a portion of the pivot pin 45 and includes outwardly extending tangs that engage the cage 41 and the lower face 47 of the disc 43, respectively, so as to continuously urge the disc to rotate toward the closed position. In the closed position, an outer peripheral edge surface 49 of the disc 43 engages a seal 50 located on a valve seat ring 51 carried by the cage 41 within a counter bore 52 at the top. Seal rings 53 and 54 prevent fluid leakage from below the lower valve element when it occupies the closed position, whereas a seal ring 55 prevents leakage past the upper valve in the closed position. In addition, a suitable ring 56 seals off any leakage between the latch sub 36 and the coupling sub 37 of the valve body section 21. Both valve assemblies 39 and 40 are held within the body section 21 by a retainer nut 57 which forces the lower cage 41 against the upper cage 41' and the upper cage against an inwardly extending shoulder 58 on the body section.

The upper end portion of the latch sub 36 has an internal seal bore 60 sized to receive a fluid coupling sleeve 61 that carries a seal packing assembly 62 which prevents fluid leakage from the flow passage 35. A detent groove 63 having upper and lower inclined surfaces 64 and 65 extends around the sub 36 and is arranged to receive the enlarged head portions 66 of a plurality of circumferentially spaced latch dogs 67. The lower end portion 68 of each latch dog is retained by a coupling ring 69 screwed onto the lower end of a sleeve member 70 that telescopes over the latch sub 36 and is formed integrally with the seal sleeve 61. The head portions 66 have inner inclined surfaces of companion shape to the surfaces 64 and 65, with each head portion being arranged for lateral movement between an inner position as shown where they engage the detent groove 63 to couple the control section 28 to the valve section 21, and an outer position disengaged from the groove where the sections are released. Normally, however, that is to say when the sections are connected to one another, the head portions 66 are positively held inwardly by an internal annular locking surface 75 extending inwardly of an elongated locking sleeve or mandrel 76 that is mounted for reciprocating movement externally of the control section 28. The lower end of the locking sleeve 76 is provided with upwardly extending slots 77, each of which engages one of a plurality of circumferentially spaced, outwardly extending lugs 78 on the coupling sub 37 to prevent relative rotation.

The control section 28 as shown principally in FIG. 2A is comprised of an elongated tubular body member 80 formed by threadedly interconnected parts and having at its lower extremity the seal and connector sleeves 61 and 70 previously described, and at its upper end a guide flange 31. Internal threads 81 adapt the body member 80 for connection to the flow conduit or pipe 21 extending upwardly to the vessel 10. A valve actuator piston assembly 82 is sealingly and slidably received within the bore 83 of the body member 80, and has a depending tubular extension 84 connected thereto by a nut 85. The sleeve 84 has a lost-motion coupling at 86 to an elongated valve actuator sleeve 87 that extends downwardly into the flow passage 35 of the valve section 21. A coil compression spring 88 is positined between a downwardly facing shoulder surface 89 provided by a ring 90 below the nut 85, and the upwardly facing end surface 91 of the actuator sleeve 87. Moreover, a second coil compression spring 92 reacts between a shoulder 93 on the body member 80 and a stop ring 94 abutting against an outer retainer ring 90' that surrounds the nut 85 which is connected to the piston assembly 82. The inner spring 88 urges the piston assembly 82 and the actuator sleeve 87 in opposite longitudinal directions, whereas the outer spring 92 urges both the piston assembly 82 and the actuator sleeve 87 upwardly within the housing member 80.

The upper portion 79 of the piston assembly 82 is formed with an outwardly extending seal flange 95 which carries a seal ring 96 in sliding engagement with a cylinder surface 97 on the body member 80. The member 80 is inwardly thickened above the surface 97 and carries a seal ring 98 in sliding engagement with an external surface 99 of the piston assembly 82. In addition, a lower seal 100 is carried by a ring 101 fixed within the housing member 80 and engages an external surface 102 of the piston assembly 82 below the seal flange 95. Accordingly, chambers 103 and 104 are formed respectively above and below the piston flange 95 in such a manner that a sufficiently predominant fluid pressure in the upper chamber 103 will force the piston assembly 82 and the extension 84 downwardly against the bias afforded by the coil spring 92, whereas a reduction in such pressure will enable the coil spring 92 to shift the piston assembly 82 upwardly. Downward movement of the piston 82 relative to the actuator sleeve 87 will compress and load the inner coil spring 88, thus applying downward force to the valve actuator sleeve tending to drive it through the lower valve seat 51 and cause pivotal rotation of the lower valve element 43 to open position. Fluid under pressure is supplied to the upper chamber 103 via a passage 105 (shown in phantom lines in FIG. 2A) extending to the upper end of the housing member 80 and connected at 106 to the control line 29 that extends upwardly along the pipe string 21 to the surface. The lower chamber 104 is communicated with another upwardly extending passage 107 through which fluid under pressure is selectively applied in connection with actuation of the latch mechanism 32 as will be described below.

The locking sleeve 76, which is slidably mounted on the exterior of the body member 80, also is spring loaded by a coil spring 110 which reacts between an inwardly directed shoulder surface 111 on the sleeve above the locking surface 75, and an outwardly directed shoulder ring 112 on the member 80. Thus it will be apparent that the spring 110 urges the locking sleeve 76 toward its lower position in relation to the housing member 80 where the latch dogs 66 are held inwardly in engagement with the detent groove 63. However, the pressure of a control fluid from the line 30 extending upwardly to the surface and connected to the passage 107 is communicated by a port 113 to a chamber 114 formed interiorly of a piston head 115 on the upper end of the locking sleeve 76. The head 115 carries upper and lower seal rings 116 and 117 with the upper seal engaging a lesser diameter surface of the member 80 than the lower seal ring. Thus it will be appreciated that with the absence of an applied pressure in the control line 30, the locking sleeve 76 normally occupies the lower position as shown and functions to lock the control section 20 and the valve section 21 together. On the other hand, applied pressure will shift the head 115 and the sleeve 76 upwardly against a stop ring 118 and enable the latch dogs 66 to be shifted laterally outwardly and thereby released from the detent groove 63 on the latching sub 36. It should be noted that pressure applied to the chamber 114 also is applied to the chamber 104 below the piston member seal flange 95, so that when the latch mechanism 32 is being released, an upward force also is positively applied to the valve actuation sleeve 87 to ensure its upward movement and automatic closure of the lower valve element 43.

To provide a back-up method for releasing the connection of the control section 20 to the valve section 21, in the event of leakage of hydraulic control fluid, or the like, a jack sleeve 120 is threaded to the body member 80 at 121, and has a spline coupling 122 to the locking sleeve 76. The jack sleeve 120 normally is fixed to the body member 80 by a shearable pin 123. Thus with the lower end of the locking sleeve 76 being held against rotation by the lugs 78 on the valve body 21, it is possible to apply torque at the surface to the pipe string 21 and the housing member 80 sufficient to shear the pin 123, and then to rotate the housing member 80 relative to the locking sleeve 76. This causes the threads 121 to elevate both the jack sleeve 120 and the locking sleeve 76 to the upper released position where the locking surface 75 is above the heads 66 of the latch dogs 67, enabling their outward movement to released position.

In operation, a production or drill stem testing tool string is lowered into the well 11 on the pipe string 16 to test depth less water depth. The subsea control valve assembly 20 is then installed in the pipe string, and the hydraulic control lines 29 and 30 from the control console and reel onboard the vessel 10 are connected to the assembly 20. The pipe is then lowered through the riser 17 until the assembly 20 is landed in the blowout preventer stack 14 at the sea floor. The various parts of the assembly 20 as it is run into the stack 14 will occupy the positions shown in FIGS. 2A and 2B, that is to say, with the actuator sleeve 87 holding the upper valve element open, and with the lower valve element closed. After the assembly 20 is landed, the lower ones of the pipe rams 15 are closed around the slick joint 22 below the valve section 21, so that the operator can control the valves and the latch mechanism 32 remotely from onboard the vessel 10.

To open the lower valve element 43 and thus allow the well to produce, pressure is applied to the line 29 which forces the piston assembly 82 downwardly, loading the spring 88 and causing it to tend to push the valve element 43 to open position. As necessary, the pipe string 21 can be pressurized to substantially equalize the pressures above and below the element 43, whereupon the actuator sleeve 87 automatically will be forced through the lower valve seat 51 by the spring 88 to open the valve element and then retain it in the open position for so long as the control line 29 remains under pressure. To close the lower valve, pressure within the line 29 and the chamber 103 is relieved by bleeding off at the surface, enabling the closure spring 92 to shift the piston assembly 82 upwardly, thereby retracting the valve actuator sleeve 87 to the position shown in FIGS. 2A and 2B and allowing the hinge spring 46 to swing the valve element 43 to closed position. It will be appreciated that the valve is "fail-close" in the sense that in the absence of the application of a positive control pressure, the valve will automatically go to the closed position where the well is shut-in.

To operate the latch assembly 32 in order to release the control section 28 from the valve section 21, pressure is applied to the control line 30 to drive the locking sleeve 76 to its upper position where the locking surface 75 is above the heads 66 of the latch dogs 67. The heads 66 are then free to be shifted out of the detent groove 63 by the inclined surface 64 as the control section 28 is moved upwardly relative to the valve section 21. Moreover, as the actuator sleeve 87 is drawn upwardly through the upper valve seat 51', the upper valve element 43' will automatically swing closed to provide a dual valve closure for shutting in the well.

A reconnection of the control section 28 with the valve section 21 is accomplished essentially in the same manner as the disconnection procedure described above. Pressure is applied to the line 30 to elevate the locking sleeve 76, and then the control section 28 is lowered onto the valve section 21. The seal sleeve 61 enters the seal bore 60, and the outer inclined surface at the upper end of the latch sub 36 cams the latch heads 66 outwardly to enable them to snap into engagement with the detent groove 63. The pressure then is bled off in the line 30, enabling the lock spring 110 to position the locking mandrel 76 in the lower position where the locking surface 75 holds the heads 66 engaged in the detent groove 63. The control section then is rotated somewhat to ensure that the slots 77 on the lower end of the locking sleeve 76 are engaged with the lugs 78 on the coupling sub 37.

During such reconnection, of course the lower end surface of the actuator sleeve 87 will first encounter the upper surface of the closed upper valve element 43', so that continued downward movement of the control section 28 will cause the inner coil spring 88 to be compressed. If there is a substantial pressure below the valve element, it will be necessary following reconnection as described above to equalize such pressure with a like pressure in the pipe 21. This enables the spring 88 to push the valve element 43' to the open position as shown in FIG. 2B. When it is desired to allow the well to produce, the lower valve element 43 is opened by pressurizing the control line 29 as previously described.

In the event of a lack of hydraulic power, or perhaps of leakage of fluids from the system, the control section 28 can be released by rotating the pipe 21 to the right, causing the pin 123 to shear and the jack sleeve 120 to mechanically feed the latch mandrel 76 to the upper, released position.

It now will be apparent that the new and improved subsea control valve system disclosed herein is simplified in construction and thus reliable in operation. The valve section 21 is short enough to allow the upper rams of the BOP stack to be closed upon disconnection and withdrawal of the control section 28. Inasmuch as all the various hydraulically operated mechanisms and associated fluid passages are located entirely within the control section 28, contamination by drilling mud or sea water is eliminated.

It will be appreciated that although the present invention has been described in connection with a drill stem or production test of a well, the apparatus has wide utility in general offshore well workover and completions operations. Moreover, the apparatus can be used to close off the drill pipe during drilling of an offshore well where it is necessary to leave the location during a storm or other emergency condition. Since certain changes or modifications may be made in the disclosed embodiment without departing from the inventive concepts involved, it is the aim of the appended claims to cover all such changes and modifications falling within the true spirit and scope of the present invention.

I claim:

1. Apparatus adapted to be positioned within a subsea blowout preventer stack or the like for controlling the flow of fluid from an offshore well, comprising: a tubular valve body arranged to be coupled to a pipe string extending into a well bore and having a flow passage and valve means arranged for movement between positions opening and closing said flow passage; tubular housing means arranged to be coupled to a pipe string extending upwardly to the surface; valve actuator means within said housing means for moving said valve means from closed to open position; releasably locked connector means for connecting and disconnecting said housing means to and from said valve body; first remotely and selectively operable means for actuating said valve actuator means to cause movement of said valve means from closed to open position; and second remotely and selectively operable means for unlocking said connector means to enable connection of said housing means to, and release of said housing means from, said valve body.

2. The apparatus of claim 1 wherein said valve means includes a valve seat surrounding said flow passage, a pivotally mounted valve element movable between an open position to the side of said flow passage and a closed position against said valve seat, and means for continuously biasing said valve element toward said closed position.

3. The apparatus of claim 2 wherein said valve actuator means includes an actuator sleeve movable downwardly through said valve seat to cause pivotal movement of said valve element to open position; spring means arranged when compressed to force said sleeve downwardly; and wherein said first remotely and selectively operable means includes hydraulically operable piston means having a lost-motion coupling with said actuator sleeve, said piston means being responsive to the pressure of a control fluid for compressing said coil spring and causing opening movement of said valve element.

4. The apparatus of claim 3 including an additional spring means reacting between said housing means and said piston means for shifting said piston means upwardly within said housing means and said actuator sleeve upwardly through said valve seat in the absence of a sufficient control fluid pressure to thereby enable said valve element to move automatically to said closed position against said valve seat.

5. The apparatus of claim 1 wherein said connector means comprises latch means mounted on said housing means and arranged for engagement with detent means on said valve body, and a mandrel movable vertically on said housing means between a first position locking said latch means in engagement with said detent means and a second position enabling release of said latch means from said detent means.

6. The apparatus of claim 5 wherein said connector means further includes spring means reacting between said mandrel and said housing means for normally positioning said mandrel in said first position.

7. The apparatus of claim 6 wherein said second remotely and selectively operable means further includes piston means sealingly slidable with respect to said housing means and responsive to the pressure of a control fluid for shifting said mandrel to said second position.

8. The apparatus of claim 7 further including alternate means for shifting said mandrel to said second position, comprising: means threaded to said housing means and having a spline coupling with said mandrel, whereby rotation of said housing means relative to said mandrel causes feeding of said mandrel from said first position to said second position.

9. The apparatus of claim 8 further including shear means for preventing rotation of said housing means relative to said mandrel until a predetermined amount of torque has been applied to said housing means.

10. The apparatus of claim 9 further including interengaged means on said mandrel and said valve body for preventing relative rotation therebetween.

11. Apparatus adapted for use in operating a subsea control valve, comprising: a body structure having a throughbore; a valve actuator sleeve disposed within said bore and having a valve actuator portion extendable beyond the lower end thereof, said actuator sleeve being movable between upper and lower longitudinal positions within said body structure; piston means movable relative to said actuator sleeve and having a transverse pressure area subject to the pressure of a control fluid, said piston means being movable in response to such pressure from an upper position to a lower position; first spring means reacting between said piston means and said actuator sleeve and functioning when compressed due to downward movement of said piston means to force said actuator sleeve toward said lower longitudinally position; and second spring means reacting between said piston means and said body structure for returning said piston means and said actuator sleeve to their respective upper longitudinal positions in the absence of sufficient pressure of a control fluid.

12. The apparatus of claim 11 further including laterally shiftable latch means carried by said body structure for connecting said body structure with a companion valve body; and a mandrel on said body structure movable betweeen one position locking said latch means in a latched position with a valve body and another position enabling lateral shifting of said latch means to a released position.

13. The apparatus of claim 12 further including spring means reacting between said body structure and said mandrel for normally positioning said mandrel in said one position; and hydraulic means responsive to the pressure of a control fluid for moving said mandrel to said other position to enable release of said latch means.

14. The apparatus of claim 13 further including alternate means for moving said mandrel from said one position to said other position, comprising means threaded to said body structure and having a spline coupling with said mandrel, whereby rotation of said body structure relative to said mandrel causes longitudinal movement of said mandrel from said one position to said other position.

15. The apparatus of claim 14 further including shearable means normally preventing rotation of said body structure relative to said mandrel, said shearable means being disrupted by the application of a predetermined torque to enable such relative rotation.

16. Valve apparatus adapted for use in a subsea well installation, comprising: a valve body sized and arranged to be lowered into a well installation and landed therein, said valve body having a throughbore defining a flow passage extending longitudinally therethrough and an internal annular recess; a valve assembly including a tubular valve cage located within said recess and surrounding said flow passage, a valve element hinged to said cage and swingable from an open position to the side thereof to a closed position transverse thereto, spring means continuously urging said valve element toward said closed position, and a valve seat carried by said cage and arranged to be engaged by said valve element in said closed position; and said valve body having a connector section constituting the upper end portion thereof, said connector section having an internal seal bore and an external latching groove adapted to cooperate with companion parts of a valve control assembly.

17. The apparatus of claim 16 further including an additional valve assembly constructed and arranged as defined in claim 16 and disposed in series therewith; and removable retainer means at the lower end of said throughbore for positioning said valve assemblies in end-to-end relation with one another and with the upper one of said valve assemblies in abutting relation with an inwardly extending shoulder defined by the upper end of said recess.

* * * * *